US006626695B2

(12) United States Patent
Enomoto et al.

(10) Patent No.: US 6,626,695 B2
(45) Date of Patent: Sep. 30, 2003

(54) METHOD OF CONNECTING FLAT CABLE AND TERMINAL

(75) Inventors: Noritsugu Enomoto, Tokyo (JP); Yoshiyuki Suzuki, Tokyo (JP); Kazumasa Sakata, Tokyo (JP); Mitsuhiro Yamamura, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 10/217,228

(22) Filed: Aug. 9, 2002

(65) Prior Publication Data

US 2003/0003795 A1 Jan. 2, 2003

Related U.S. Application Data

(63) Continuation of application No. PCT/JP01/10902, filed on Dec. 12, 2001.

(30) Foreign Application Priority Data

Dec. 12, 2000 (JP) ..... 2000-377204

(51) Int. Cl.[7] ..... H01R 11/20
(52) U.S. Cl. ..... 439/422
(58) Field of Search ..... 439/417, 422, 439/421, 424, 425, 426, 430

(56) References Cited

U.S. PATENT DOCUMENTS 3,247,316 A * 4/1966 Weimer, Jr. ..... 174/94 R
3,713,072 A 1/1973 Henschen et al. ..... 439/425
3,924,917 A * 12/1975 Munshower ..... 439/422
4,066,319 A * 1/1978 Baker et al. ..... 439/422
4,082,402 A 4/1978 Kinkaid et al. ..... 439/422
4,124,266 A * 11/1978 Wagstaff ..... 439/422
4,957,453 A * 9/1990 Owen ..... 439/422
6,267,618 B1 * 7/2001 Hio ..... 439/422
6,461,188 B2 * 10/2002 Reul ..... 439/422

FOREIGN PATENT DOCUMENTS

JP 46-36032 10/1971
JP 5-69863 9/1993

* cited by examiner

*Primary Examiner*—Tulsidas Patel
(74) *Attorney, Agent, or Firm*—Knobbe, Martens, Olson & Bear, LLP

(57) ABSTRACT

A method of connecting a flat cable and a terminal in which a flat cable comprising a flat conductor (1*a*) insulated with an insulation (1*b*) in the form of a tape and a terminal (5) having a cramp piece (5*c*) are connected by sticking the cramp piece (5*c*) through the flat cable at a place corresponding to an intended portion of the flat conductor, and bending the cramp piece that has been stuck through the flat cable, toward the flat conductor to clamp the flat cable. An end portion of the cramp piece (5*c*) is made to project from the flat cable by a length that is in the range of 50~5% of the length of the cramp piece, and then the end portion of the cramp piece is bent.

4 Claims, 5 Drawing Sheets

PRIOR ART

METHOD OF CONNECTING FLAT CABLE AND TERMINAL

This application is a continuation of PCT/JP01/10902 filed Dec. 12, 2001.

TECHNICAL FIELD

The present invention relates to a method of connecting a flat cable for use in, for example, wiring in electric apparatus and automobiles, and a terminal.

BACKGROUND ART

As shown in FIG. 6, a flat cable 1 comprises flat conductors 1*a* insulated with an insulation 1*b* in the form of a tape, while a terminal 3 has cramp pieces 3*a* projecting on the opposite sides thereof.

Conventionally, the flat cable 1 and the terminal 3 are connected as follows: As shown in FIG. 6, the cramp pieces 3*a* are stuck through the insulation 1*b* on the opposite sides of an intended flat conductor 1*a* so that more than 50% of their length may project from the insulation 1*b*. Then, the end portions of the cramp pieces 3*a* that have been stuck through the insulation 3*a* are bent inward as shown by a broken line. The insulation 1*b* is broken with the ends of the cramp pieces 3*a,* so that the cramp pieces 3*a* come in contact with the flat conductor 1*a*.

However, in this connecting method, depending on the length by which the cramp pieces 3*a* project from the insulation 1*b* and the way in which the cramp pieces 3*a* are bent, it may be difficult to break the insulation 1*b* with the ends of the cramp pieces 3*a* to thereby bring the cramp pieces 3*a* in contact with the flat conductor 1*a*. In that case, stable connection is not obtained.

An object of the present invention is to provide a method of connecting a flat cable and a terminal in which a flat cable and a terminal can always be connected in a good and stable state.

Another object of the present invention is to provide a method of connecting a flat cable and a terminal in which a flat cable and a terminal can be connected in a stable state and a cramp piece is bent into an intended shape easily.

DISCLOSURE OF THE INVENTION

The present invention is to improve a method of connecting a flat cable and a terminal in which a flat cable comprising a flat conductor insulated with an insulation in the form of a tape and a terminal having a cramp piece are connected by sticking the cramp piece through the flat cable at a place corresponding to an intended portion of the flat conductor, and bending the cramp piece that has been stuck through the flat cable, toward the flat conductor to clamp the flat cable.

The method of connecting a flat cable and a terminal according to the present invention is characterized in that an end portion of the cramp piece is made to project from the flat cable by a length that is in the range of 50~5% of the length of the cramp piece, and then the end portion of the cramp piece is bent.

Also, the method of connecting a flat cable and a terminal according to the present invention is characterized in that an end portion of the cramp piece is made to project from the flat cable by a length that is in the range of 50~5% of the length of the cramp piece and then the end portion of the cramp piece is bent; and the cramp piece is connected with the flat conductor at a first place where the cramp piece has been stuck through the flat conductor and a second place where an inner surface of the end portion of the cramp piece that has been bent is in contact with an outer surface of a bent portion of the flat conductor that has been bent.

When the end portion of the cramp piece is made to project from the flat cable by a length that is in the range of 50~5% of the length of the cramp piece and then bent as described above, the flat cable and the terminal can be connected in a good and stable state not only at a first place where the cramp piece has been stuck through the flat conductor but also at a second place where the inner surface of the end portion of the cramp piece that has been bent is in contact with the outer surface of a bent portion of the flat conductor. Especially at the second place, the contact is very stable, and therefore, the connection is highly reliable, because it is formed in a manner that the inner surface of the end portion of the cramp piece that has been bent is in contact with the outer surface of the bent portion of the flat conductor.

When the length by which the end portion of the cramp piece projects from the flat cable is more than 50% of the length of the cramp piece, the connection lacks stability and therefore the reliability of the connection lowers. When the length by which the end portion of the cramp piece projects from the flat cable is less than 5% of the length of the cramp piece, the end portion of the cramp piece is not bent sufficiently, so that the second connection is not formed.

Further, the method of connecting a flat cable and a terminal according to the present invention is characterized in that a terminal comprising a substrate with a window and a plurality of cramp pieces projecting on opposite sides of the substrate is used.

This method of connection ensures that the cramp piece that has been stuck through the flat cable is bent appropriately. As a result, the flat cable and the terminal can always be connected in a good and stable state.

BEST MODE OF CARRYING OUT THE INVENTION

Figure 1A:
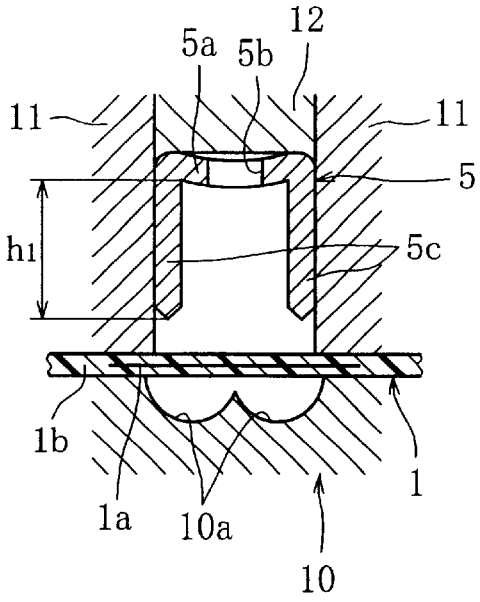
FIGS. 1A to 1C are cross-sectional views showing steps of an embodiment of method of connecting a flat cable and a terminal according to the present invention.

In the method according to the present invention, a terminal 5 shown in FIG. 1A is used. The terminal 5 is a member comprising a substrate 5*a* with a window 5*b* and a plurality of cramp pieces 5*c* of an length h1 projecting on the opposite sides of the substrate 5*a,* and has a cross section like a staple.

The flat cable 1 and the terminal 5 are connected as follows: As shown in FIG. 1A, the flat cable 1 is placed on a forming cramp 10. In the upper surface of the forming cramp 10 is formed a bending concave portion 10*a* for bending the cramp pieces 5*c* of the terminal 5 inward.

In this state, the terminal 5 having the projecting cramp pieces 5*c* is pressed with a pressing member 12, being guided by guides 11. As a result, the cramp pieces 5*c* are stuck through the flat conductor 1*a,* and the cramp pieces 5*c* that have been stuck through the flat conductor 1*a* are bent inward with the bending concave portion 10*a* of the forming cramp 10 to clamp the flat cable 1.

Figure 1B:
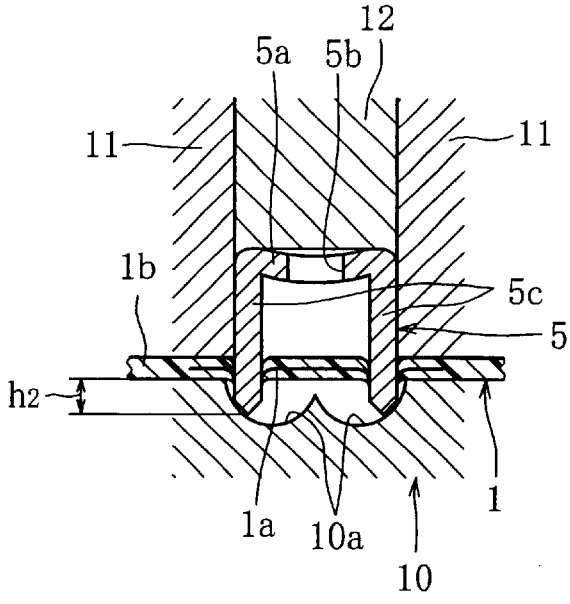

A characteristic feature of the method according to the present invention is that the end portion of each cramp piece 5*c* is made to project from the flat cable 1 by a length that is in the range of 50~5% of the length h1 of the cramp piece 5*c* (see FIG. 1A), and then the end portion of each cramp piece 5*c* is bent. The projecting length h2 by which the end portion of each cramp piece 5*c* projects from the flat cable 1 (see FIG. 1B) is arranged to be in the range of 50~5%, preferably 40~5% of the cramp piece 5*c* length h1, and on that condition, the end portion of the cramp piece 5*c* is bent with the bending concave portion 10*a*.

Figure 1C:
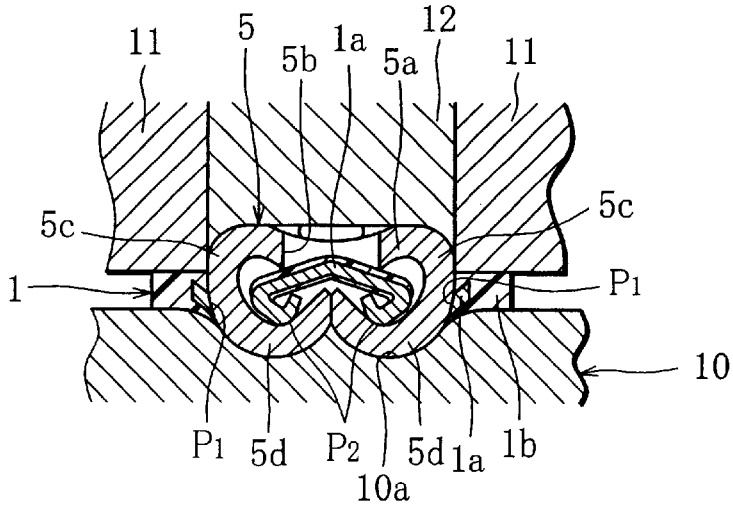

In this case, as shown in FIG. 1C, the cramp piece 5*c* is connected with the flat conductor 1*a* at a first place P1 where the cramp piece 5*c* has been stuck through the flat conductor 1*a* and at a second place P2 where the inner surface of the end portion 5*d* of the cramp piece 5*c* that has been bent is in contact with the outer surface of a bent portion 1*c* of the flat conductor 1*a* that has been bent. Thus, the flat cable 1 and the terminal 5 can be connected in a stable and good state. In addition, since the terminal 5 has a window 5*b* as stated above, the flat conductor 1*a* is prevented from being pressed between the end of the cramp piece 5*c* and the substrate 5*a* and damaged.

Especially at the second place P2, since the inner surface of the bent portion 5*d* is in contact with the outer surface of the bent portion 1*c* of the flat conductor 1*a,* the contact is very stable, and therefore, the connection is highly reliable.

Next, why the flat cable 1 and the terminal 5 can be connected in a good state when the end portion of the cramp piece 5*c* is bent on the condition that the projecting length h2 of the cramp piece 5*c* is arranged to be in the range of 50~5%, preferably 40~5% of the cramp piece 5*c* length h1 will be explained in detail.

FIGS. 2A to 2D relate to the present invention in which the projecting length h2 of the cramp piece 5*c* is arranged to be in the range of 50~5%, preferably 40~5% of the cramp piece 5*c* length h1, and show, on the basis of an experiment, how the end portion of the cramp piece 5*c* is bent. In other words, FIGS. 2A to 2D show how the end portion of the cramp piece 5*c* projecting from the flat cable 1 is bent when the projecting length h2 of the cramp piece 5*c* is short.

Figure 2A:
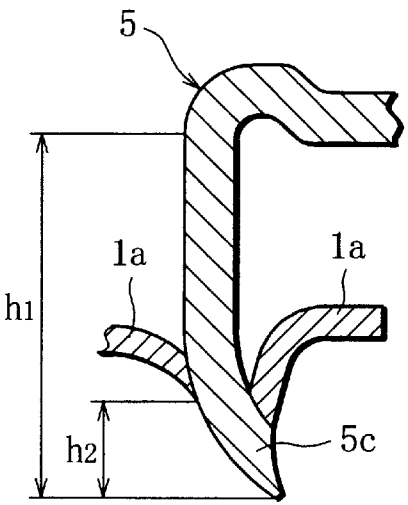
FIGS. 2A to 2D are cross-sectional views of main parts, showing how an end portion of a cramp piece projecting from a flat cable is bent into a curved shape, when the length by which the end portion of the cramp piece projects from the flat cable is in the range of 50~5% of the length of the cramp piece.
Figure 2B:
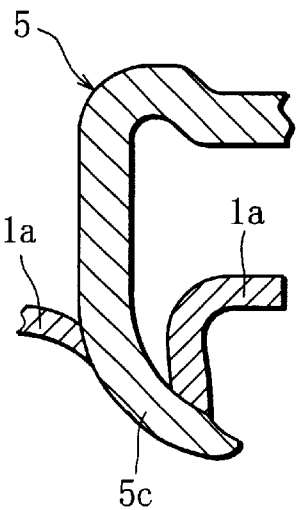
Figure 2C:
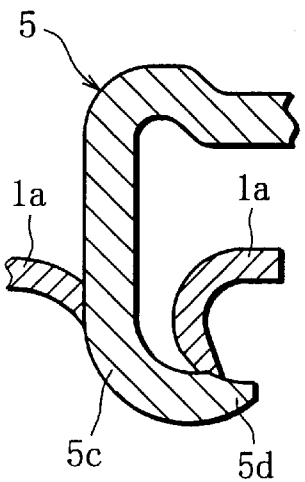
Figure 2D:
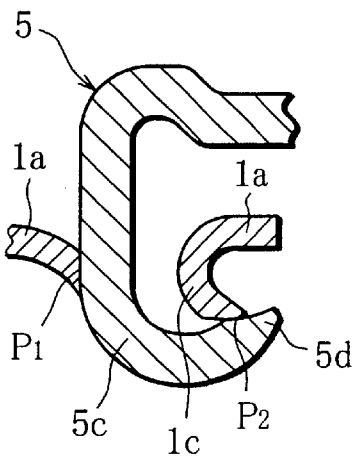

FIG. 2D shows a state in which the end portion of the cramp piece 5*c* has been bent into its final shape. In this state, each cramp piece 5*c* is connected with the flat conductor 1*a* at two places, i.e., a first place P1 where the cramp piece 5*c* has been stuck through the flat conductor 1*a* and a second place P2 where the inner surface of the bent portion 5*d* is in contact with the outer surface of the bent portion 1*c*. Especially at the second place P2, since the inner surface of the bent portion 5*d* is pressed against the bent portion 1*c* of the flat conductor 1*a,* a very stable connection is formed.

In contrast thereto, FIGS. 3A to 3D relate to an example for comparison with the present invention in which the projecting length h2 of the cramp piece 5*c* is more than 50% of the cramp piece 5*c* length h1, and show, on the basis of an experiment, how the end portion of the cramp piece 5*c* is bent. In other words, FIGS. 3A to 3D show how the end portion of the cramp piece 5*c* projecting from the flat cable 1 is bent when the projecting length h2 of the cramp piece 5*c* is too long.

Figure 3A:
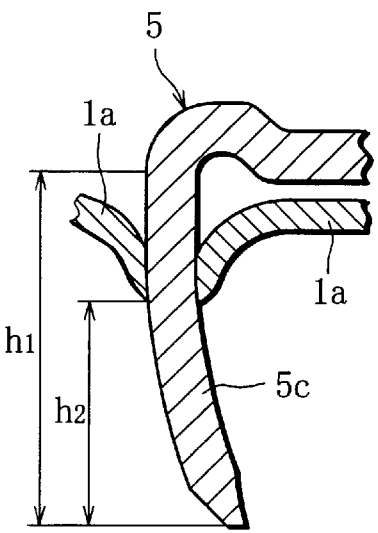
FIGS. 3A to 3D are cross-sectional views of main parts of a comparison example, showing how an end portion of a cramp piece projecting from a flat cable is bent into a curved shape, when the length by which the end portion of the cramp piece projects from the flat cable is more than 50% of the length of the cramp piece.
Figure 3B:
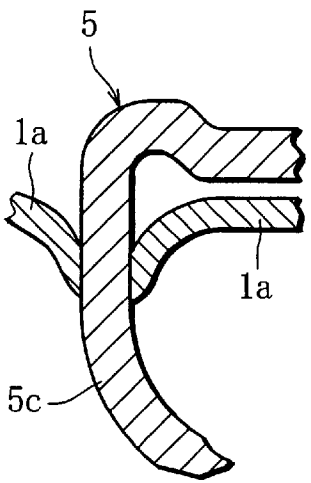
Figure 3C:
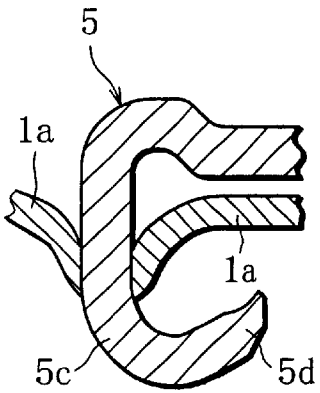
Figure 3D:
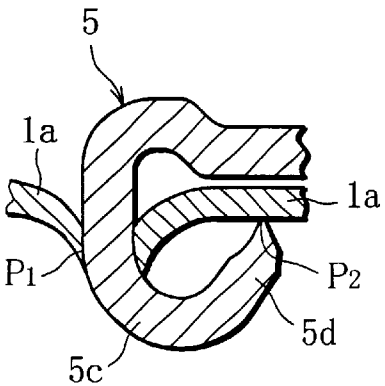

FIG. 3D shows a state in which the end portion of the cramp piece 5*c* has been bent into its final shape. As seen from FIG. 3D, each cramp piece 5*c* is connected with the flat conductor 1*a* at two places, i.e., a first place P1 where the cramp piece 5*c* has been stuck through the flat conductor 1*a* and a second place P2 where the inner surface of a bent portion 5*d* is in contact with the outer surface of a bent portion 1*c,* like in the state shown in FIG. 2D. However, at the second place P2, only an edge of the bent portion 5*d* is in contact with the flat conductor 1*a,* which is very different from the way of contact at the second place P2 in FIG. 2D.

FIGS. 2A to 2D and FIGS. 3A to 3D are on the basis of an experiment where a cramp piece 5*c* for a wide use of 2.3 mm in tab width was used.

Figure 4:
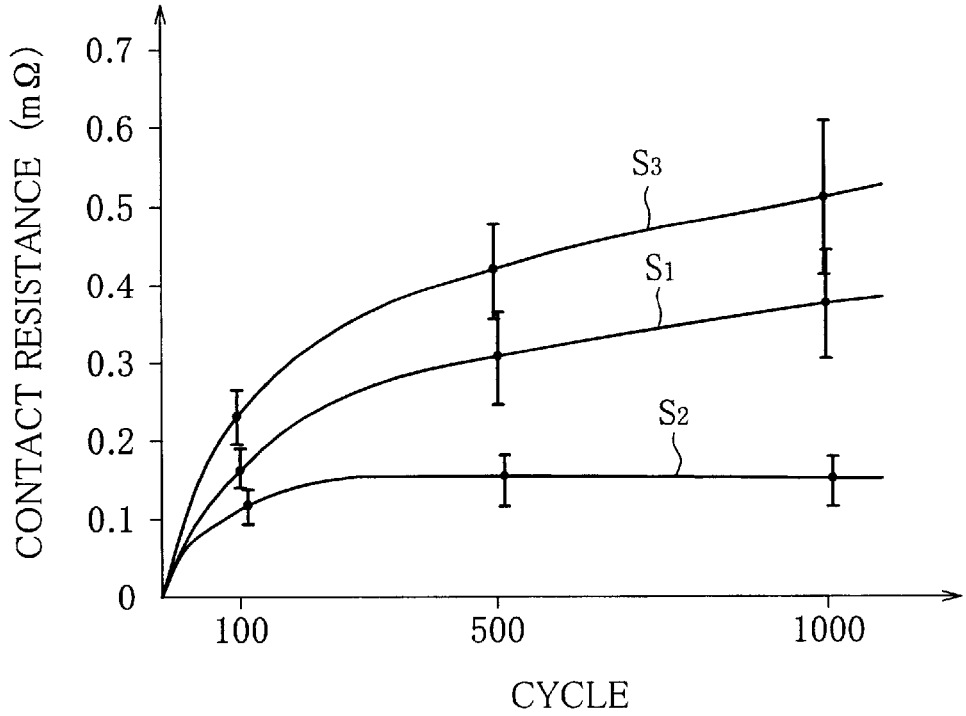
FIG. 4 is a graph showing the result of measurement of how contact resistance varied when thermal shock was given to three kinds of samples S1~S3 each prepared by connecting a cramp piece to a flat conductor.
Figure 6:
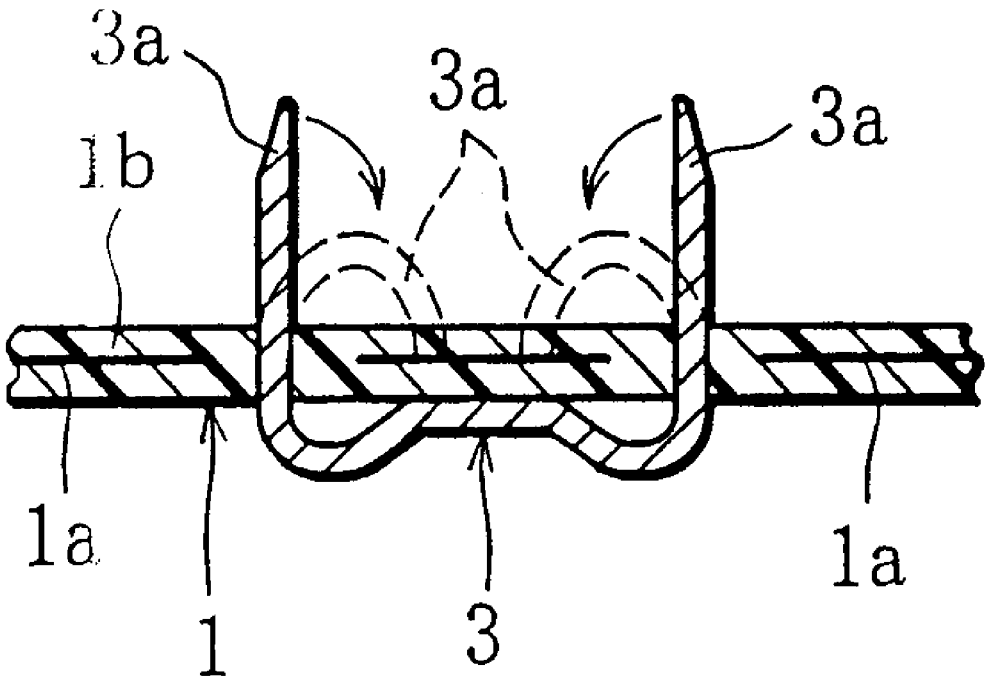
FIG. 6 is a cross-sectional view showing an example of conventional method of connecting a flat cable and a terminal.

FIG. 4 is a graph showing the result of a thermal shock test where thermal shock of +80° C.~−30° C. was given to three kinds of samples S1 to S3 each prepared by connecting a cramp piece 5*c* for a wide use of 2.3 mm in tab width to a flat conductor 1*a*. Sample S1 was a comparison example as shown in FIG. 3 where the projecting length h2 was 65% of the cramp piece 5*c* length h1, sample S2 was an embodiment of the present invention as shown in FIG. 2 where the projecting length h2 was 35% of the cramp piece 5*c* length h1, and sample S3 was an conventional example as shown in FIG. 6.

As seen from FIG. 4, it was found that the connecting portion of sample S2 according to the present invention showed stable contact resistance relative to thermal shock. Specifically, it was found that the connecting portion showed more stable contact resistance relative to thermal shock when the end portion of the cramp piece 5*c* having the projecting length h2 that was in the range of 50~5% of the cramp piece 5*c* length h1 was bent than when the end portion of the cramp piece 5*c* having the projecting length h2 that was more than 50% of the cramp piece 5*c* length h1 was bent.

Figure 5:
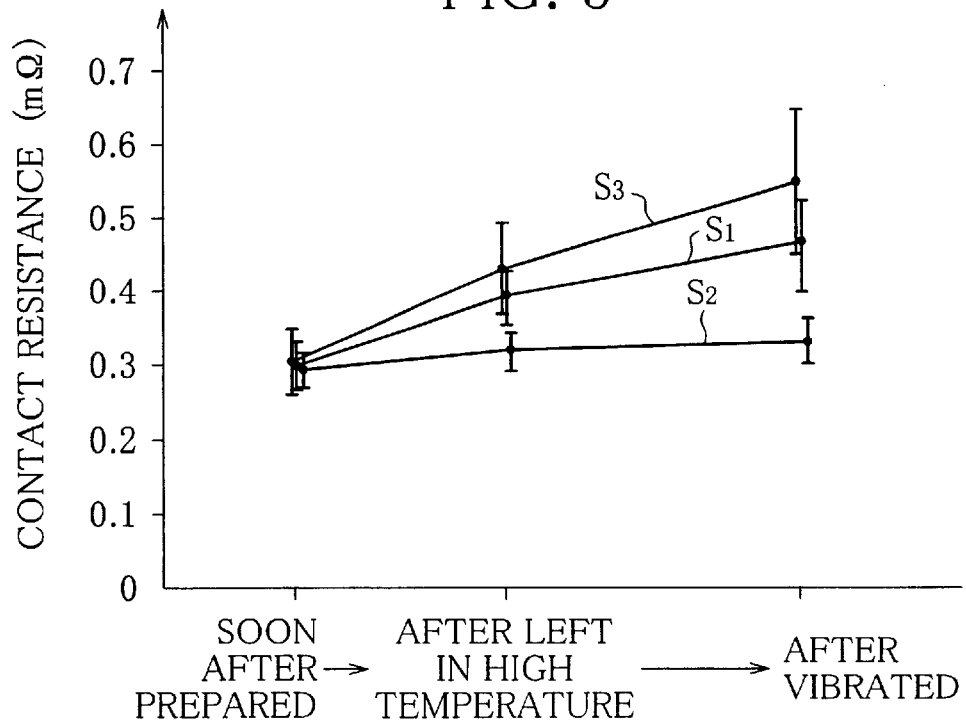
FIG. 5 is a graph showing the result of measurement of how contact resistance varied when the three kinds of samples S1~S3 were left in a high temperature and then subjected to a vibration test.

FIG. 5 is a graph showing the result of measurement of how contact resistance in the above-mentioned three kinds of samples S1 to S3 varied. The terminal and the flat cable are thought to be used in an environment that varies. Therefore, contact resistance in each sample was measured three times, that is, soon after the sample was prepared, after the sample was left in a high temperature for a predetermined time (100° C.×120 hours), and after the sample was subjected to a vibration test. In the vibration test, the sample was vibrated back and forth, left and right, and up and down with 4.5 G at 20~200 Hz with a sweep time of 3 minutes.

As seen from FIG. 5, it was found that the connecting portion of sample S2 according to the present invention showed stable contact resistance relative to variation in temperature and vibration. Specifically, it was found that the connecting portion showed more stable contact resistance relative to variation in temperature and vibration when the end portion of the cramp piece 5*c* having the projecting length h2 that was in the range of 50~5% of the cramp piece 5*c* length h1 was bent than when the end portion of the cramp piece 5*c* having the projecting length h2 that was more than 50% of the cramp piece 5*c* length h1 was bent.

In the above description of the embodiment, an example has been dealt with where a single flat cable 1 and cramp pieces 5*c* of a terminal 5 are connected. The method of connecting a flat cable and a terminal according to the present invention is however not restricted to the above-described embodiment. The present invention can be applied to the case where a plurality of flat cables 1 placed one on another are connected so that flat conductors 1*a* in the flat cables 1 are connected by cramp pieces 5*c*.

Also in this case, when the projecting length h2 of the cramp piece is more than 50% of the cramp piece length h1, the connection lacks stability and therefore the reliability of the connection lowers. When the projecting length h2 of the cramp piece is less than 5% of the cramp piece length h1, the end portion of the cramp piece is not bent sufficiently, so that the stable connection cannot be formed at the second place.

INDUSTRIAL APPLICABILITY

In the method of connecting a flat cable and a terminal according to the present invention, a cramp piece and a flat conductor are connected not only at a first place where the cramp piece has been stuck through the flat conductor but also at a second place where the inner surface of an end portion of the cramp piece that has been bent is in contact with the outer surface of a bent portion of the flat conductor. Thus, the flat cable and the terminal can be connected in a good and stable state. Especially at the second place, the contact is very stable, and therefore, the connection is highly reliable, because it is formed in a manner that the inner surface of the bent end portion of the cramp piece is in contact with the outer surface of the bent portion of the flat conductor.

In addition, in the method of connecting a flat cable and a terminal according to the present invention, a bending concave portion of a forming cramp has a shape adapted to bend an end portion of a cramp piece that projects from a flat cable by a length that is in the range of 50~5% of the cramp piece length. Thus, the end portion of a cramp piece that projects from a flat cable can be bent into an intended shape, easily.

What is claimed is:

1. A method of connecting a flat cable and a terminal in which a flat cable comprising a flat conductor insulated with an insulation in the form of a tape and a terminal having a cramp piece are connected by sticking said cramp piece through said flat cable at a place corresponding to an intended portion of said flat conductor, and bending said cramp piece that has been struck through said flat cable, toward said flat conductor to clamp the flat cable; the method comprising:

projecting an end portion of said cramp piece from said flat cable by a length until said end portion is in the range of 5–50% of the length of said cramp piece, and then beginning to bend said end portion.

2. A method of connecting a flat cable and a terminal in which a flat cable comprising a flat conductor insulated with an insulation in the form of a tape and a terminal having a cramp piece are connected by sticking said cramp piece through said flat cable at a place corresponding to an intended portion of said flat conductor, and bending said cramp piece that has been stuck through said flat cable, toward said flat conductor to clamp said flat cable, the method comprising:

protecting an end portion of said cramp piece from said flat cable by a length until said end portion is in the range of 5–50% of the length of said cramp piece; and then beginning to bend said end portion; and wherein said cramp piece is connected with said flat conductor at a first place where said cramp piece has been stuck through said flat conductor and a second place where an inner surface of said end portion of said cramp piece that has been bent is in contact with an outer surface of a bent portion of said flat conductor that has been bent by the protection of the end portion.

3. The method of connecting a flat cable and a terminal according to claim 1, wherein a terminal comprising a substrate with a window and a plurality of cramp pieces projecting on opposite sides of said substrate is used.

4. The method of connecting a flat cable and a terminal according to claim 2, wherein a terminal comprising a substrate with a window and a plurality of cramp pieces projecting on opposite sides of said substrate is used.

* * * * *

UNITED STATES PATENT AND TRADEMARK OFFICE

CERTIFICATE OF CORRECTION

PATENT NO. : 6,626,695 B2
DATED : September 30, 2003
INVENTOR(S) : Enomoto et al.

It is certified that error appears in the above-identified patent and that said Letters Patent is hereby corrected as shown below:

Column 6,
Line 22, which reads “protecting”, should read -- projecting --.
Line 34, which reads “protection”, should read -- projection --.

Signed and Sealed this

Second Day of November, 2004

JON W. DUDAS
*Director of the United States Patent and Trademark Office*